US007540687B2

(12) United States Patent
Neumann

(10) Patent No.: US 7,540,687 B2
(45) Date of Patent: Jun. 2, 2009

(54) SKID STEER LOADER ATTACHMENT FOR PERFORMING ROAD WIDENING AND SHOULDERING JOBS

(76) Inventor: Duane A. Neumann, 3258 N. Highway D, Jefferson, WI (US) 53549

( * ) Notice: Subject to any disclaimer, the term of this patent is extended or adjusted under 35 U.S.C. 154(b) by 191 days.

(21) Appl. No.: 11/653,555

(22) Filed: Jan. 16, 2007

(65) Prior Publication Data

US 2007/0201952 A1 Aug. 30, 2007

Related U.S. Application Data

(60) Provisional application No. 60/776,756, filed on Feb. 24, 2006.

(51) Int. Cl.
*E01C 19/20* (2006.01)

(52) U.S. Cl. ..... 404/104; 108/110

(58) Field of Classification Search ..... 404/101, 404/104, 108, 110

See application file for complete search history.

(56) References Cited

U.S. PATENT DOCUMENTS

| | | | | |
|---|---|---|---|---|
| 4,871,025 | A * | 10/1989 | Mayfield et al. | 172/4.5 |
| 6,619,881 | B1 * | 9/2003 | Harvey | 404/107 |
| 6,619,882 | B2 * | 9/2003 | Harvey | 404/107 |
| 6,702,208 | B1 * | 3/2004 | Hadler et al. | 239/668 |
| 7,033,106 | B2 * | 4/2006 | Harvey | 404/107 |
| 2003/0215288 | A1 * | 11/2003 | Causie et al. | 404/104 |

* cited by examiner

*Primary Examiner*—Gary S Hartmann
(74) *Attorney, Agent, or Firm*—von Briesen & Roper, s.c.

(57) ABSTRACT

An attachment for a skid steer loader for use in performing road widening and shouldering jobs in small areas such as bike paths, driveways and cul de sacs. The attachment includes a compact frame adapted to support a hopper, a conveyor system, a spreader system, a spreader system angular adjustment, a hydraulic system, at least one wheel, at least one contact roller, and a universal mounting plate. The hydraulic system receives its power from the hydraulic system of, for example, a skid steer.

10 Claims, 3 Drawing Sheets

SKID STEER LOADER ATTACHMENT FOR PERFORMING ROAD WIDENING AND SHOULDERING JOBS

REFERENCE TO PRIOR APPLICATION

The present invention claims the benefit of U.S. Provisional Application Ser. No. 60/776,756, filed on Feb. 24, 2006.

FIELD OF THE INVENTION

The present invention relates to a road widening and shouldering attachment. More specifically, the present invention relates to a skid steer loader attachment that can be utilized for the widening and shouldering of roads.

BACKGROUND OF THE INVENTION

The use of after-market attachments for road widening and shouldering is well known to the construction industry. For instance, U.S. Pat. No. 4,790,715 discloses an accessory that is attached to the rear end of a dump truck to divert construction material into a road shoulder or trench located on the side of the dump truck. U.S. Pat. No. 4,900,185 discloses a spreader box that is attached to a rear side of a dump truck to place asphalt on a road shoulder or trench located on the side of the dump truck. U.S. Pat. No. 6,612,774 discloses construction material applicator and compacting devices that are attached, respectively, to the rear and front sides of a dump truck to spread and compact construction material placed on a road shoulder or trench located on the side of the dump truck. Because of the large size of the dump truck—attachment combination and the high cost of purchasing or renting a dump truck, contractors are always concerned with the transportation of the attachment, the size of a working area, and accessibility to dump trucks. Consequently, there is a need for a road widening and shouldering attachment that can be operated within a small area, transported in standard size trailers and trucks, and operated with equipment, such as a skid steer loader, which is readily available to all contractors.

SUMMARY OF THE INVENTION

The present invention resolves the shortcomings and fulfills the needs identified above. The invention relates to a light, maneurable, durable and easy to transport attachment for a skid steer loader that can be used for performing road widening and shouldering jobs in small areas such as bike paths, driveways and cul de sacs. To fulfill these needs, the invention is provided with a compact frame that is adapted to support a hopper, a conveyor system, a spreader system, a spreader system angular adjustment, a hydraulic system, at least one wheel, at least one contact roller, and a universal mounting plate. To power the invention, its hydraulic system is connected to the hydraulic system of the skid steer loader to which the invention is attached.

There has thus been outlined, rather broadly, the more important features of the present invention so that its detail description, following below, and contributions to the art may be better understood. To this effect, those of ordinary skill in the art should readily recognize the features and advantages of the present invention upon a reading of the detailed description, in conjunction with the accompanying drawings, of the currently preferred and illustrative embodiments of the invention. Thus, before discussing the preferred embodiment of the invention in detailed, it should be understood that the invention should not be limited in its application to the details of the specific components, manufacturing, and arrangement illustrated in the description and drawings below. The invention may be represented in other embodiments and may be practiced in other similar or equivalent manner. Also, it should be understood that the phraseology and terminology utilized herein is not intended and should not be interpreted as being limiting of the present invention.

It is therefore an object of the present invention to provide a road widening and shouldering attachment that may be used in conjunction with a skid steer loader or other similar device.

It is another object of the present invention to provide a road widening and shouldering attachment that may be adaptable to fit a variety of skid steer loaders regardless of their origin/manufacturer.

It is another object of the present invention to provide a road widening and shouldering attachment that is adaptable to use a skid steer loader as its means for locomotion.

It is another object of the present invention to provide a road widening and shouldering attachment that may be adaptable to use the hydraulic system of a skid steer loader for powering the hydraulic system of the road widening and shouldering attachment.

It is another object of the present invention to provide a road widening and shouldering attachment that is light enough to be easily transported, moved and manipulated by the a skid steer loader.

It is another object of the present invention to provide a road widening and shouldering attachment that is adaptable to be transported on a standard width trailer, truck or other similar vehicle.

It is another object of the present invention to provide a road widening and shouldering attachment that may be conveniently manufactured from a variety of materials.

It is another object of the present invention to provide a road widening and shouldering attachment that may be conveniently installed during the manufacturing of a skid steer loader or other similar device.

It is another object of the present invention to provide a road widening and shouldering attachment that may be conveniently retrofitted onto a skid steer loader or other similar device.

It is another object of the present invention to provide a road widening and shouldering attachment that provides a nonpermanent, easily removable structure or structures.

It is another object of the present invention to provide a road widening and shouldering attachment that provides selective adjustability (its positioning with relation to a skid steer loader or other similar vehicle).

It is another object of the present invention to provide a road widening and shouldering attachment of relatively simple construction that is relatively simple to install, adjust, or reconfigure.

It is another object of the present invention to provide a road widening and shouldering attachment that may be used to deliver a variety of construction materials such as asphalt, stone, top soil, decorative stone and the like.

It is another object of the present invention to provide a road widening and shouldering attachment that is adaptable to deliver a variety of construction materials from various locations/sides.

The above together with other objects of the invention, along with various features of novelty that characterize the invention, are identified and explained with more particularity in the claims annexed to and forming part of this disclosure. For a better understanding of the invention, its operating advantages and specific objects attained by its uses, reference should be made to the accompanying drawings and descriptive matter in which there are illustrated preferred embodiments of the invention.

DETAILED DESCRIPTION OF THE PREFERRED EMBODIMENT

Figure 1:
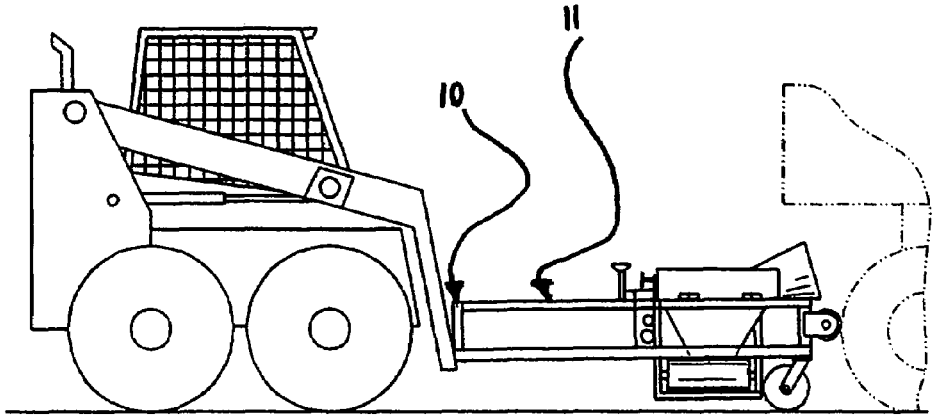
FIG. 1 shows a side view of an exemplary embodiment of a road widening and shouldering attachment as used on a skid steer loader.

Referring to the drawings, and particularly to FIGS. 1 to 5, in which like reference numbers indicate similar parts in the various views, a preferred embodiment of the invention is shown in FIG. 1.

Figure 3:
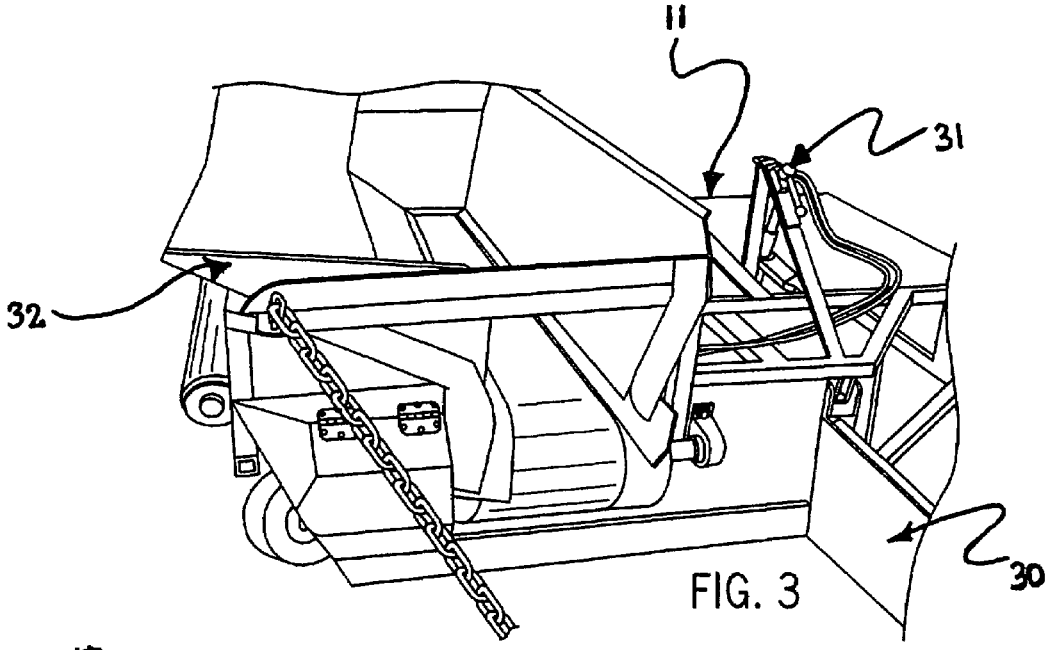
FIG. 3 shows a perspective and sectional view of the exemplary embodiment of FIG. 2.
Figure 4:
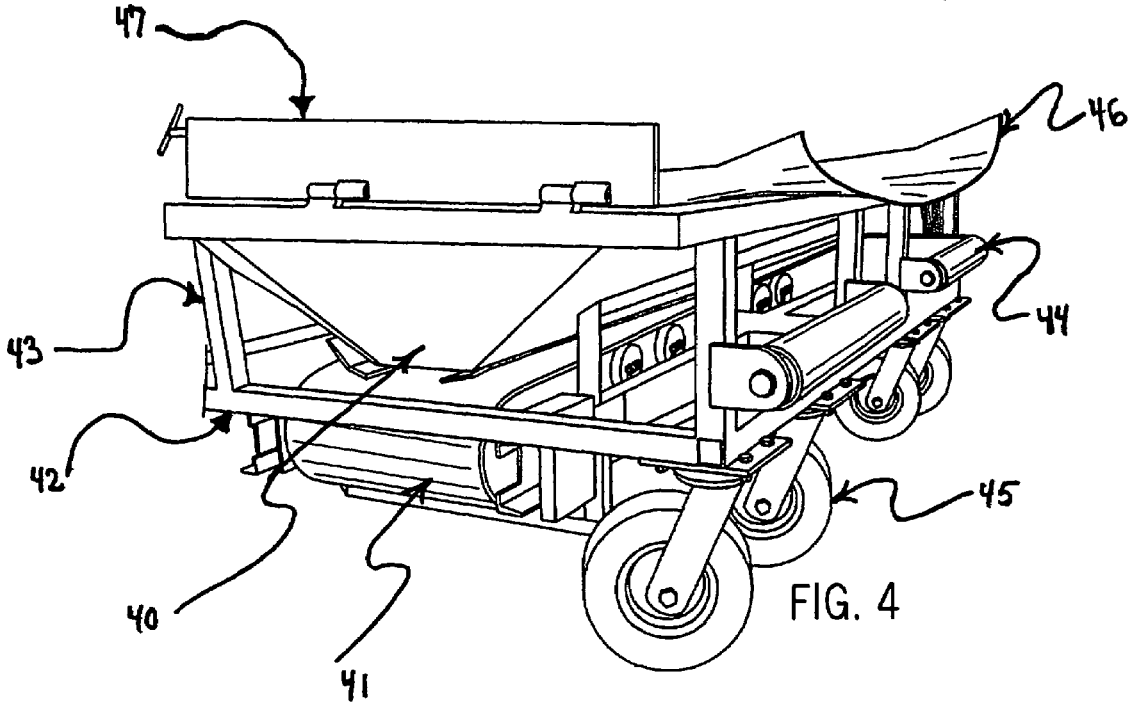
FIG. 4 shows a perspective and sectional view of the exemplary embodiment of FIG. 2.

As shown in FIGS. 3 and 4, the road widening and shouldering attachment is made by a support frame 11 (as conformed by a multiplicity of horizontal 42 and vertical 43 members), a hopper 40, a conveyor system 41, a spreader system 30, a spreader system angular adjustment 31, front rollers 44, and wheels 45. The horizontal 42 and vertical 43 members of the support frame 11 are generally fastened together by welding although other fastening means such as bolts or pins may also be utilized.

As shown in FIGS. 3 and 4, the hopper 40 is conformed by four walls positioned in an angular manner as to form a vertically oriented open container capable of receiving construction materials through its upper opening and capable of delivering the same construction materials through its lower opening to the conveyor system 41. Although the walls of the hopper 40 may be constructed from any materials strong enough receive and support construction materials, wall 46 is made of a flexible but durable material such as steel-belted rubber. Except for walls 46 and 47, the other walls are fastened together and to the support frame 11 by welding although other fastening means such as bolts or pins may also be used. Wall 46 is fastened to the other walls by fastening means such as bolts or pins. Additional support is provided to Wall 46 through the use of spring loaded or resilient cables which are fastened at one end to Wall 46 and at the other end to support frame 11. Wall 47 is fastened on the opposite side of the spreader system 30, to the two longest walls, in a manner that permits wall 47 to collapse in the direction of the spreader system 30 as to decrease the overall width of the road widening and shouldering attachment. Wall 32 is fastened in a manner that permits construction material to exit the hopper 40 when the conveyor system 41 is activated in the direction of the spreader system 30.

As shown in FIGS. 3 and 4, the conveyor system 41 is conformed by a conveyor belt and a multiplicity of rollers that are horizontally aligned beneath the lower opening of the hopper 40. Each roller is rotably fixed to the support frame 11. The conveyor belt is positioned around the rollers with a first outer most roller, fastened in a manner that permits its displacement as to increase the tension in the conveyor belt. A gear box and hydraulic motor assembly is fixed to one end of a second outermost roller, on the opposite side of the first outermost roller, as to rotate the conveyor belt around the rollers and cause construction material to exit hopper 40 at the side of the spreader system 30. The conveyor system 41 is positioned at a sufficient distance from the lower opening of the hopper 40 as to permit rotation of the conveyor belt without excessive friction against the lower opening of the hopper 40.

Figure 2:
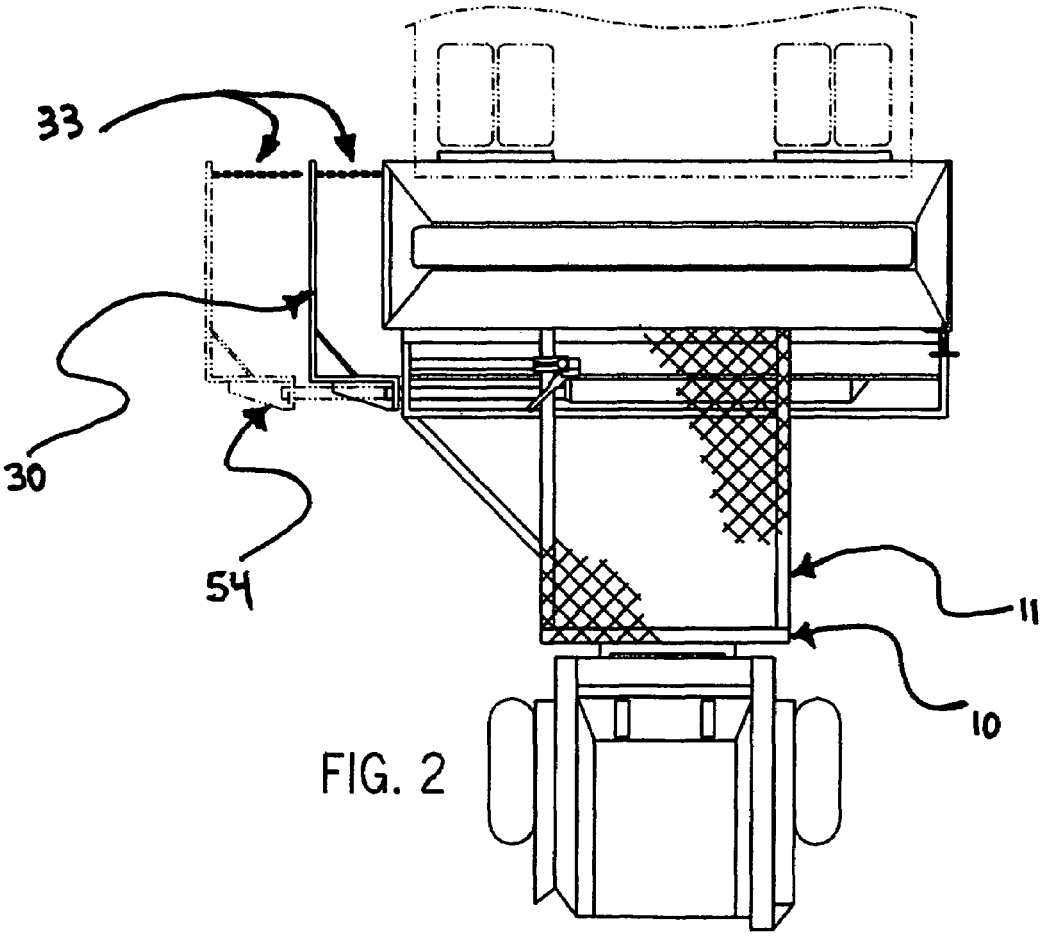
FIG. 2 shows a top view of an exemplary embodiment of the road widening and shouldering attachment and skid steer loader of FIG. 1.
Figure 5:
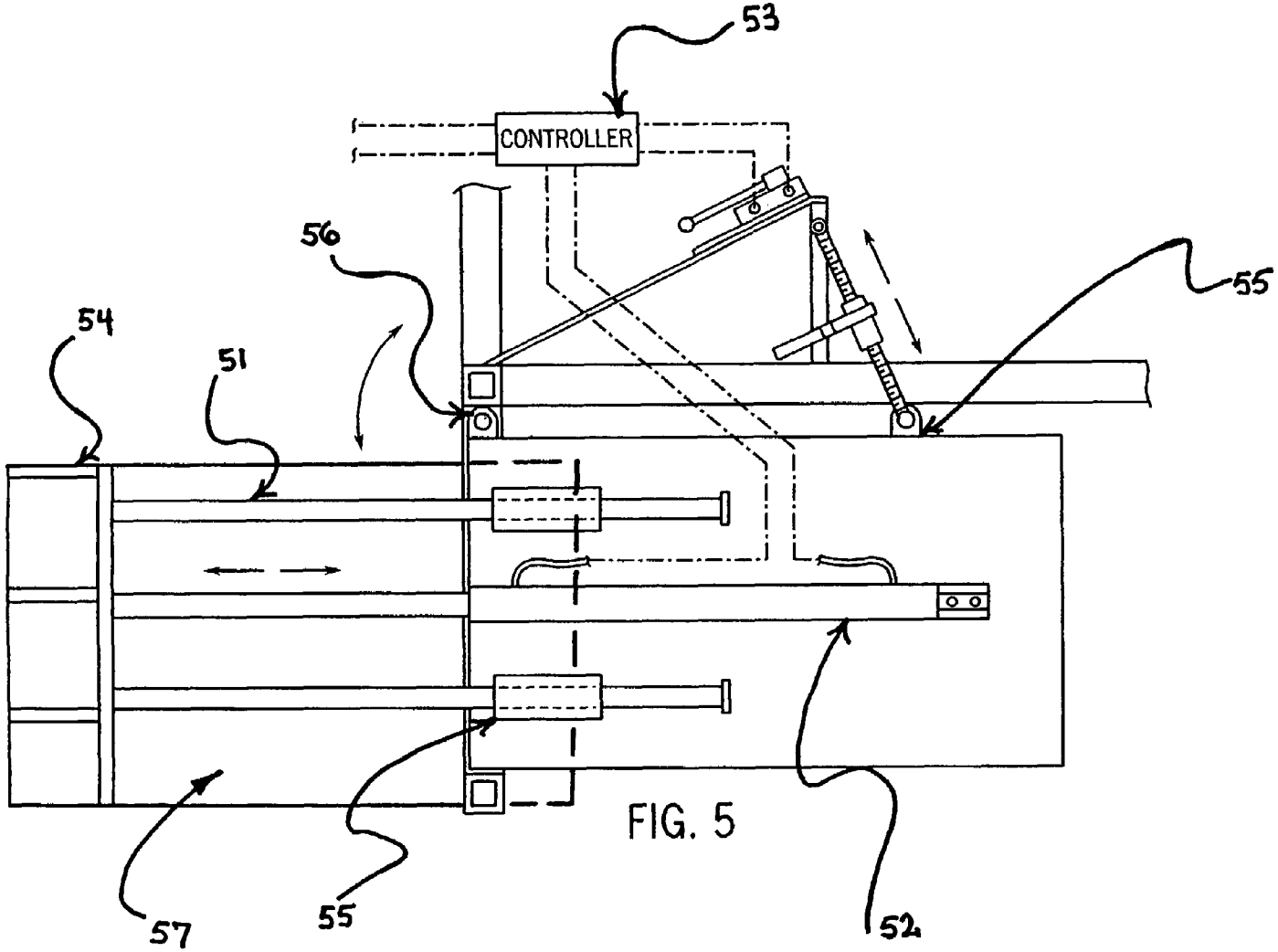
FIG. 5 shows an exploded and sectional view of the exemplary embodiment of FIG. 2.

As shown in FIGS. 2 and 5, the spreader system 30 is conformed by a two walls fastened together to form a right angle (spreader elbow), supporting means 33 attached to one of the walls of the spreader elbow (the supporting means 33 may be a device of varying length such as a chain, link or bar), at least one guide rod 51 and one hydraulic cylinder/ram assembly 52, at least one two-way hydraulic valve/controller 53 for actuating the hydraulic cylinder/ram assembly, a first mounting frame 54 for securing one end of the guide rod and one end of the hydraulic cylinder/ram assembly to the right angle end formed by the two walls, a second mounting frame 55 for guiding and securing the other end of the guide rod and hydraulic cylinder/ram assembly and for pivotally securing 56 the spreader system 30 to the support frame 11, a support plate 57, and a spreader system angular adjustment 31 for pivoting the spreader system 30 about the support frame 11. The two walls of the spreader system 30 are generally fastened together by welding although other fastening means such as bolts or pins may also be used. The first mounting frame 54 is generally fastened to one of the walls of the spreader system 30 by bolts although other fastening means such as welding or pins may also be utilized. The two walls are to be of sufficient height and thickness as to facilitate the even spreading of construction material without significant deflection of the two walls. The length of one of the walls is to be long enough to permit its placement across the width of the second mounting frame 55 and the support frame 11. The longer wall is frictionally secured to the second mounting frame 55 as to allow the longer wall to be displaced in the direction in which the hydraulic ram is displaced when actuated. The spreader system angular adjustment 31 is oriented at an angle with its upper end fastened to the support frame 11 and its lower end fastened to the second mounting frame 55. The spreader system 30 is pivoted about the support frame 11 as the spreader system angular adjustment 31 is actuated. The spreader system angular adjustment 31 is a torque-screw assembly although another assembly such as a hydraulic cylinder/ram assembly may also be used to pivot the spreader system 30 about the support frame 11. The two-way hydraulic valve/controller 53 is generally fastened onto the support frame 11 by bolts, clamps, or pins.

As shown in FIGS. 3 and 5, the hydraulic system is conformed by a gear box and hydraulic motor assembly, a hydraulic cylinder/ram assembly 52, and a two-way hydraulic valve/controller 53. The hydraulic system is powered by connecting it to a hydraulic coupler located within the skid steer loader for the operation of skid steer loader attachments. These connections are set up in a manner that permits an operator of a skid steer loader to activate the conveyor system 41 and the spreader system 30 simultaneously or independently of each other by using the standard controls of the skid steer loader. The hydraulic system is generally fastened to the support frame 11 by bolts, clamps or pins.

As shown in FIGS. 1 and 2, the road widening and shouldering attachment is attached to a skid steer loader by the universal mounting plate 10. The universal mounting plate 10 is oriented in parallel with the skid steer loader's mounting plate and is fastened to the skid steer loader's mounting plate by a friction joint, bolts or clamps. The universal mounting plate 10 is part of the support frame 11. In a preferred embodiment of the invention, the universal mounting plate 10 is of rectangular shape and incorporates a horizontal mounting lip along its upper edge and at least one mounting guide perpendicular to the horizontal mounting lip.

In an alternative configuration, hopper 40, conveyor system 41, spreader system 30, spreader system angular adjustment 31, and supporting means 33 can be reconfigured around support frame 11 as to permit hopper 40 to collapse and construction material to be discharge and spread on the sides opposite as those disclosed above.

What is claimed is:

1. An attachment for a skid steer loader comprising:

(a) support frame having a width, length and height, a first and a second end with the first end being of greater width and height than the second end, and adapted to support a hopper, a conveyor system, a spreader system, a spreader system angular adjustment, a hydraulic system, at least one wheel, at least one contact roller, and a universal mounting plate;

(b) a hopper for receiving construction material and directing it in a downward direction, having an open, a collapsible end, and being attached to the support frame at the first end;

(c) a conveyor system attached to the support frame at the first end, at a sufficient distance beneath the hopper as to permit the conveyor system to receive construction material from the hopper and redirect it in the direction of the open end of the hopper;

(d) a spreader system pivotably attached at the first end of the support frame, having two walls connected to each other to form a right angle spreader elbow, a guide rod and hydraulic cylinder and ram assembly attached to each other in a manner that permits the hydraulic cylinder and ram assembly to move the spreader elbow in the same direction as the open end of the hopper;

(e) a spreader system angular adjustment having a first and a second ends pivotably attached, respectively, at the first end of the support frame and to the hydraulic cylinder and ram assembly of the spreader system as to cause the spreader system to change its angular position with respect to the support frame when the spreader system angular adjustment is activated;

(f) a hydraulic system for powering the conveyor system and the spreader system, having a gear box and hydraulic motor assembly, a hydraulic cylinder and ram assembly and at least one two-way hydraulic valve and controller all attached to each other, to the support frame, and to an external hydraulic power source;

(g) at least one wheel rotably attached at the first end of the support frame in a manner that maintains the first end of the support frame above ground level and permits the rolling of the support frame when it is pushed or pulled by a skid steer loader;

(h) at least one contact roller rotably attached at the first end of the support frame in a manner that permits the contact roller to rotate when it comes in contact with an external wheel; and (i) a universal mounting plate attached at the second end of the support frame in a manner that allows the mounting plate to be engaged by a skid steer loader.

2. The attachment for a skid steer loader of claim 1, further comprising removable and adjustable supporting means for providing additional support to the open end of the spreader elbow.

3. The attachment for a skid steer loader of claim 1, where width, length and height of the support frame are small enough as to allow a skid steer loader operator to have a direct line of sight with the construction material that is being deposited by the spreader system.

4. The attachment for a skid steer loader of claim 3, where the skid steer loader attachment is light enough as to be lifted over obstacles when engaged to a skid steer loader.

5. The attachment for a skid steer loader of claim 4, where the support frame is made of steel.

6. The attachment for a skid steer loader of claim 4, where the support frame is made of aluminum alloy.

7. The attachment for a skid steer loader of claim 4, where the hopper is made of reinforced rubber.

8. The attachment for a skid steer loader of claim 4, where the hopper is made of engineered plastic.

9. The attachment for a skid steer loader of claim 4, where the hopper is made of steel.

10. The attachment for a skid steer loader of claim 4, where the hopper is made of aluminum alloy.

* * * * *